US007245561B2

(12) United States Patent
Coleman

(10) Patent No.: US 7,245,561 B2
(45) Date of Patent: Jul. 17, 2007

(54) WATER FEATURE

(76) Inventor: James David Coleman, c/o James Designs Ltd, The Old Tannery, Kelston, Bath BA1 9AN (GB)

( * ) Notice: Subject to any disclaimer, the term of this patent is extended or adjusted under 35 U.S.C. 154(b) by 822 days.

(21) Appl. No.: 10/056,000

(22) Filed: Jan. 28, 2002

(65) Prior Publication Data

US 2002/0134856 A1 Sep. 26, 2002

(30) Foreign Application Priority Data

| | | |
|---|---|---|
| Feb. 3, 2001 | (GB) | 0102793.7 |
| Oct. 5, 2001 | (GB) | 0123949.0 |
| Dec. 7, 2001 | (GB) | 0129314.1 |

(51) Int. Cl.
*G04B 1/26* (2006.01)
*G04B 19/18* (2006.01)

(52) U.S. Cl. ..... 368/65; 368/223

(58) Field of Classification Search ..... 368/62, 368/65, 76, 223, 276, 93; 137/552.7, 624.11–27; 968/21; 239/17

See application file for complete search history.

(56) References Cited

U.S. PATENT DOCUMENTS

| | | | | |
|---|---|---|---|---|
| 3,773,258 | A * | 11/1973 | Hruby, Jr. | 239/17 |
| 3,782,629 | A * | 1/1974 | Hruby, Jr. | 239/17 |
| 4,028,877 | A | 6/1977 | Vatterott | |
| 4,262,348 | A * | 4/1981 | Hess | 368/65 |
| 4,372,688 | A * | 2/1983 | Chatten | 368/65 |
| 4,376,314 | A * | 3/1983 | Iwans | 4/431 |
| 4,412,924 | A * | 11/1983 | Feather | 210/744 |
| 4,457,363 | A * | 7/1984 | Villeval | 165/104.32 |
| 4,516,726 | A * | 5/1985 | Hoie | 239/317 |
| 4,625,780 | A | 12/1986 | Burnham | |
| 4,928,326 | A * | 5/1990 | Olin et al. | 4/300 |
| 4,974,264 | A * | 12/1990 | Brian | 4/300 |
| 5,421,040 | A * | 6/1995 | Oldfelt | 4/435 |
| 5,468,066 | A * | 11/1995 | Hammonds | 366/139 |
| 5,470,151 | A * | 11/1995 | Walthall et al. | 366/165.1 |
| 5,692,250 | A * | 12/1997 | Oldfelt et al. | 4/432 |
| 6,065,860 | A * | 5/2000 | Fuchsbichler | 366/136 |
| 6,253,584 | B1 * | 7/2001 | Shin | 68/13 R |
| 6,397,405 | B1 * | 6/2002 | Grech et al. | 4/420 |

FOREIGN PATENT DOCUMENTS

| | | |
|---|---|---|
| DE | 38 19 648 | 12/1989 |
| DE | 299 02 849 | 8/1999 |
| DE | 198 59 621 | 7/2000 |
| GB | 2 290 353 | 12/1995 |

* cited by examiner

*Primary Examiner*—Vit W. Miska
(74) *Attorney, Agent, or Firm*—Morrison & Foerster LLP

(57) ABSTRACT

The invention provides a water feature comprising a vessel containing a volume of water and means for imparting rotational motion thereto, wherein means are also provided for varying the height of the volume of water in the vessel. The invention also provides a method of operating a water feature comprising at least one vessel containing a volume of water, comprising the steps of causing the or a volume of water to rotate about an axis thereof so as to form a vortex therein and causing the rotating volume of water to vary in height over time.

18 Claims, 11 Drawing Sheets

B
B
17
17
4
22
20
10
3
2
1
6
23
5
12
11
7
24
25
26
13
14
16
9
15
8
27
28

WATER FEATURE

FIELD OF THE INVENTION

The present invention relates to a water feature, specifically to an ornamental water feature. Particularly, but not exclusively, the invention relates to a water feature whose appearance gives an indication of the time.

BACKGROUND OF THE INVENTION

Displays exist where a fixed volume of water in a tube is stirred by a paddle-wheel at the bottom. A vortex shape will form and a partial air column (a free surface) will be drawn down from the top. Other fixed-volume displays exist where a pump is used to draw water out of the bottom of a tube and where it is reintroduced on the tangent, either at the top or bottom of the tube. These systems create a vortex but suffer from the disadvantage that, with a sufficient flowrate, the air column which is drawn down from the top surface of the water can achieve an uninterrupted path into the inlet of the pump. This air entrainment into the pump can cause cavitation and the air that passes through the pump is passed back to the tube with the water. This causes an emulsion of bubbles and cloudiness which detracts very much from the display that is achieved. Re-introducing the water at the top of the column reduces this air bubble problem, but requires a supply pipe up the side of the water feature which also detracts from the appearance of the display.

SUMMARY OF THE INVENTION

The invention provides a water feature comprising a vessel for containing a volume of water and having a body, a water inlet and a water outlet, the water inlet being arranged substantially tangentially to the body of the vessel so as to impart rotational movement to the volume of water when water is introduced thereto, and a controller for controlling the rate of water inlet in comparison to the rate of water outlet so as to vary the height of the volume of water in the vessel. The invention also provides a water feature comprising:

(a) a water reservoir;

(b) a first vessel having a body, a water inlet communicating with the water reservoir and a water outlet communicating with the water reservoir, the water inlet being arranged so as to introduce water tangentially to the body of the first vessel;

(c) an inlet valve associated with the water inlet of the first vessel and an outlet valve associated with the water outlet of the first vessel;

(d) a controller associated with the inlet valve of the first vessel and the outlet valve of the first vessel to allow the rate of water entry to the first vessel to be controlled with respect to the rate of water outlet therefrom;

(e) a second vessel having a body, a water inlet communicating with the water reservoir and a water outlet communicating with the water reservoir, the body of the second vessel surrounding the body of the first vessel;

(f) an inlet valve associated with the water inlet of the second vessel and an outlet valve associated with the water outlet of the second vessel, the water inlet of the second vessel and the water outlet of the second vessel being associated with the controller to allow the rate of water entry to the second vessel to be controlled with respect to the rate of water outlet therefrom;

(g) a pump for selectively transferring water from the water reservoir to either the water inlet of the first vessel or the water inlet of the second vessel.

The invention further provides a method of operating a water feature comprising at least one vessel containing a volume of water, comprising the steps of causing the volume of water to rotate about an axis of the vessel so as to form a vortex therein and causing the volume of water to vary in height over time.

This invention recognises that an advantageous step for the pumped system is to use a separate sump of water. The pump is then able to draw non-aerated water from the sump and to discharge it tangentially into the vessel containing the vortex (preferably at the bottom). The drain flow, which can be a mixture of air and water, flows through pipework back to the sump. By means of a deflector, as the water flows into the sump, the air escapes (through buoyancy) and is not drawn into the pump inlet, which is positioned low down below the surface of the water in the sump.

Unlike in the fixed-volume arrangements, the sump brings the advantage of the variable volume system—one in which the height of the vortex can be altered by changing either the pumping rate and/or the drain rate.

The bottom arrangement of the vessel containing a vortex is mostly dictated by the plumbing requirements of the water flows.

The arrangement at the top of the vessel is not otherwise defined and it can take a number of forms. An obvious arrangement is for the top of the vessel to be open to the atmosphere, thereby allowing air to be expelled or drawn back in as the water level in the vessel is varied. A dust cover is a useful addition and it also reduces the gurgling sound that occurs with the two-phase flow drain. With an open top, the water level could be increased to such an extent that it flows out over the top of the vessel. Some applications would make use of and benefit from this effect, others definitely would not.

In this invention, the vortex is generated and maintained by pumping water tangentially into the bottom of the vessel and by simultaneously allowing the water to flow out of a drain located in the middle and at the bottom of the vessel. If the amount of water flowing into the vessel exceeds the amount flowing out, then the fill level of the vessel (and the height of the vortex) will increase with time. If the amount of water flowing into the vessel is less than that flowing out, then the height of the vortex will decrease with time. If the two flows are matched, then the vortex height will remain constant.

The vortex that forms has the characteristic profile of a free vortex, with an air column in the central region. The exact definition or shape of the vortex is not critically important in the context of this invention.

Therefore, in this invention, as the input pump rate and or the output drain rate are varied, then so too will the height of the contained vortex vary. The presence and extent of the air column that forms is dependent upon both the swirling motion set up by the water flow from the tangential inlet and the flow out through the central drain. If at any time the central drain is closed off, then the extent of the air column will reduce. It could reduce to nothing. With sufficient flow through the central drain, the air column will be drawn down beyond the bottom of the vessel into the pipework connected to the drain.

The positioning of the inlet and outlets are not critical to the formation of the vortex and are not material to the present invention. Indeed, the central drain can even be slightly displaced from the axis of the vessel and the inlet and outlet can be displaced upwards from the bottom of the vessel.

Similarly, the size, the shape and the position of the water inlet or inlets and outlet or outlets can be tuned for an optimised effect, but these are not critical at least to the creation of the vortex effect. Optimised configurations also exist for the drain assembly after the inlet to the vessel drain and these are presented hereafter.

The invention of a contained variable height vortex of water can be applied to a number of different uses.

One of these is in a water clock and this is now described.

In one embodiment of the invention, the water vortex is generated in a circular tube and the level of the vortex is varied in height to indicate the minutes in an hour. One preferred design is to surround the tube containing the vortex with a second larger tube (a further vessel), thereby forming a coaxial annular space which can also contain water made to vary in height to indicate the hours within a twelve (or other) hour period.

The coaxial tubes contain two separate volumes of water, but they are within the same system and can share the same sump. The volumes of water bounded by the tubes can function independently. The inner tube containing the vortex fills over one hour. In one embodiment, the outer volume of water in the coaxial annular space fills over twelve hours. This filling can occur smoothly as a continuous process or it can, for example, be achieved in steps at the change of the hour. The water in the coaxial annular space can have a float on top. The inner tube empties on the hour. At twelve noon and twelve midnight, both tubes empty together. Lighting within the feature illuminates the water.

The method of filling and emptying the further vessel, which may be a circular tube as in the clock embodiment described above, is known. However, because both vessels are part of one embodiment of the invention, the top detail of the further vessel is important and one configuration is explained in the example of the invention described hereafter.

To provide the water-height control required in the clock, pressure transmitters can be used to measure the hydrostatic pressure of the water in the two coaxial vessels. These can be connected to an electronic control system which controls the pump or pumps so that the levels of water in the two vessels correspond to the desired minute and hourly readings.

If, in spite of a dust (and noise) cover, both vessels have an air passageway to the outside to allow venting, thereby avoiding their pressurisation or de-pressurisation, then the water-level control and overflow prevention has to be extremely accurate and reliable. In a clock, water overflow must be prevented under all circumstances. This imposes a significant cost.

Also, for aesthetic reasons, especially with a clock, it is best for the water to be able to reach the top of the vessels (or to become very close to the top), but it cannot do so with the vented top. This is because, if the control system went out of calibration or became unreliable, then the water could pour out over the top of the clock. Therefore, for practical reasons, it is necessary to leave a significant margin of error. This is not ideal and it also creates the possibility of condensation remaining on the parts of the vessels which are never wetted by water.

One aspect of the invention proposes that the top of the vessel containing the vortex can be sealed, making it air (and hence water and dust) tight. This then removes the chance of water escaping and leaking onto the floor. It means that air can no longer escape out of the top of the vessel as it is filled with water, or be drawn back through the top of the vessel as it is being emptied.

This invention also proposes that, typically in the clock, the coaxial annular space (outside of the vessel containing the vortex) can also be sealed at its top, but that it can be vented into the vessel containing the vortex. This will be explained hereafter.

With a sealed top, the air pressure equalisation on filling and emptying has to find another route to atmosphere. A feature of this invention is that the air can be vented through the central drain of the vortex.

First, consider only the vessel containing the vortex. If this has a sealed top, as the water enters the vessel, the air will either become pressurised or the excess air will need to be expelled. With the vortex flow described above, the generation of the air column in the middle of the drain allows the excess air pressure to be relieved through the drain.

On filling, the pump is on. The appropriately-sized drain will be open and the combination of the two cause an air core to exist. If the pump is turned off completely, the swirl in the water volume (which sustains the vortex) will reduce. If it reduces too far, the air column will not be maintained. In this case, the reduced pressure in the volume of air above the volume of water will greatly slow or stop the exit of water through the drain.

However, if the pump rate is not reduced too far, or the drain rate is increased during the emptying cycle, then there will be sufficient swirl to maintain the air column, but the water level will fall. Experiments, without optimisation work, show that a test volume of water can be emptied sufficiently quickly. Note that the fill cycle is much easier to achieve because the pump must be on and so the air column is stronger. It is on the emptying cycle that the pump flow and/or drain flow must be controlled to maintain the swirling vortex motion which allows the air venting to be maintained.

In a clock embodiment of the invention, the inner vessel can be contained within the further vessel which is then sealed at its top. If the inner vessel is empty, then the further vessel can vent through the drain of the inner vessel. And, as stated above, if the vortex flow in the inner vessel is properly controlled, then the further vessel can continue to vent during both filling and emptying.

Also, in a clock embodiment of the invention, the top of the inner vessel will be very close to, but just below, the inside of the top of the further vessel. It will be possible to fill both vessels to very close to the top. Either vessel could overflow into the other, but neither vessel would overflow outside of the system. The only vent is to the sump. This brings a further advantage because the air flow into and out of the vessel and further vessel can be filtered remotely via the remote sump. This together with properly conditioned, maintained and filtered water means that the vessel and further vessel may never need internal cleaning.

One variation would be to deliberately add air, at various times and especially on the emptying cycle, to the sealed-top system. This could be from an air pump connected to the manifold at the bottom of the vessels. Air would form as bubbles which could pass upwards through the flow in either the inner vessel or the further vessel or through both vessels. With the co-vented system, an air supply from the inner vessel could vent the further vessel. In some circumstances, an over pressure could be applied to increase the rate of emptying of either vessel. The additional air input may not be essential but it may also produce an attractive effect.

In a clock embodiment of the invention, if the outer volume of the clock is sealed at the top and is not vented to the inner volume, then it will not be possible to fill the outer volume with water without alternative means to allow the trapped air to be expelled. This problem could be solved by providing a one-way valve which would admit air as the outer volume empties.

In the embodiment of the clock, the use of a sealed top allows much less critical level sensing. Obviously it is important that the clock keeps time, but if an overfill situation occurred, it would not cause an escape of water.

In the embodiment of the clock, with the safety provided by the sealed top, it is possible to consider not using pressure transmitters to control the height of the two water columns. Overfill and overflow safety features are also not required. Without the feedback of pressure transmitters, the delivery of the pump or pumps needs to be calibrated and this can undertaken during commissioning and possibly also during routine maintenance.

The use of a centrifugal pump to control the inner vessel is the most practical. The further vessel can also be filled by a centrifugal pump or can be continuously filled by a dosing pump. One centrifugal pump, with a valve-operated flow cross-over system, can be shared between the two vessels. The type of pump or pumps selected will depend, but not exclusively, upon the display type required, the location of the pump or pumps, the shape of the further vessel and the design of the control system and its feed-back measuring system, if used. The use of two separate centrifugal pumps for the two water volumes allows for simple recovery after a power failure. Dosing pumps are generally noisy and may not be suitable if, for practical reasons, the pump needs to be in 'ear shot' of the clock display. Different valve arrangements are required with centrifugal and dosing pumps.

The clock is one application of the invention. This technology can be applied to other water feature displays which make use of vortices. Whenever it is desired to generate a vortex in a vessel, the top can be sealed (with a fully transparent lid if desired) and the attractive visual effect can be achieved without the use of sophisticated and expensive level control systems. In a single vessel, the vortex can be taken to its very top. When this happens the appearance changes. Allowing the vessel or further vessel to fill to capacity, enables further switching determined by pressure and this enables the control to be set up to achieve a number of effects. None of this would be possible with a vented top.

BRIEF DESCRIPTION OF THE DRAWINGS

The embodiments of the invention will now be described in detail with reference to the accompanying drawings wherein.

DETAILED DESCRIPTION OF THE INVENTION

Figures 1A, 1B:
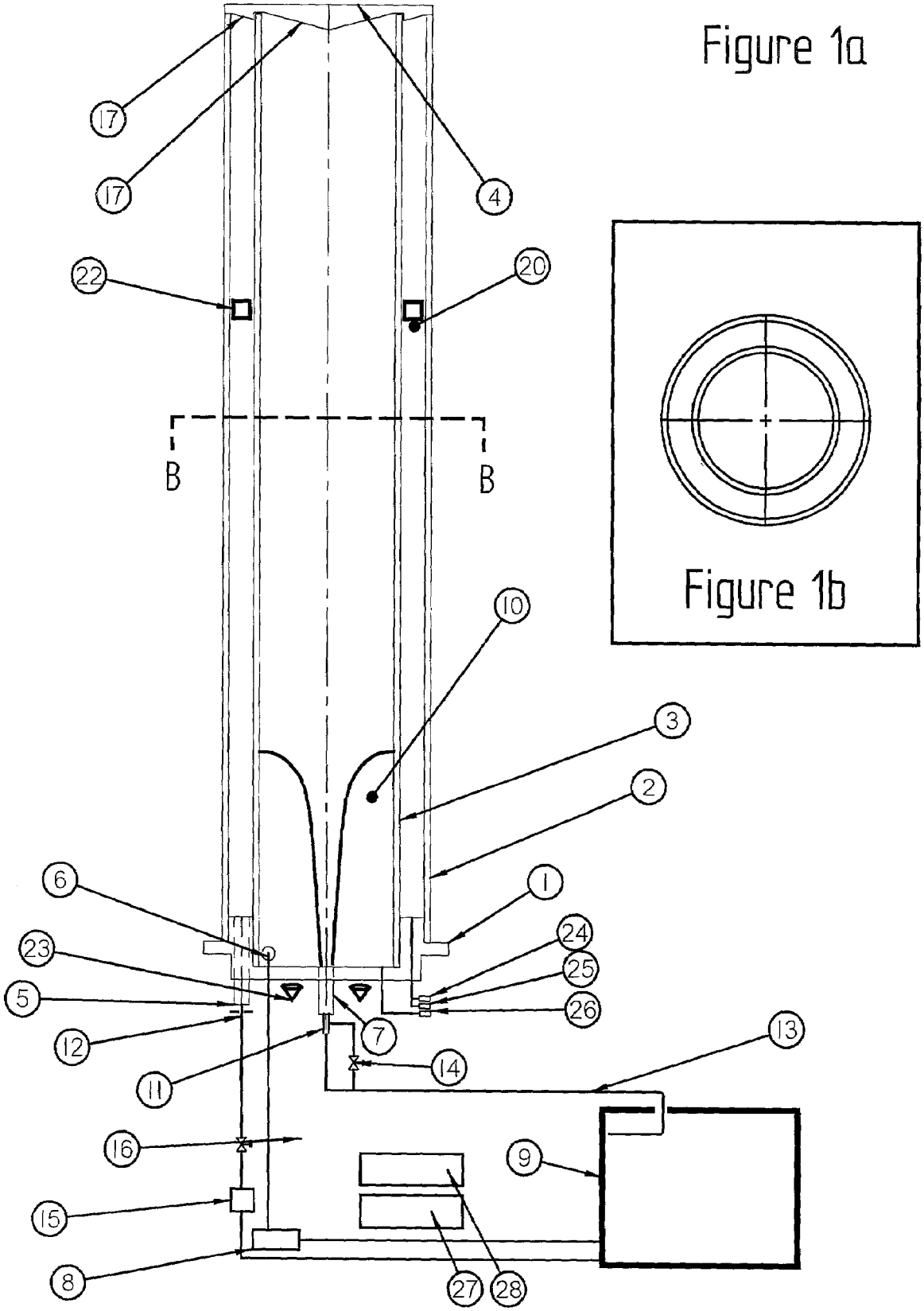
FIG. 1*a* is a schematic side sectional view of a water feature according to a first embodiment of the invention.
FIG. 1*b* is a sectional view of the water feature of FIG. 1 a taken along the line B-B.
Figure 2:
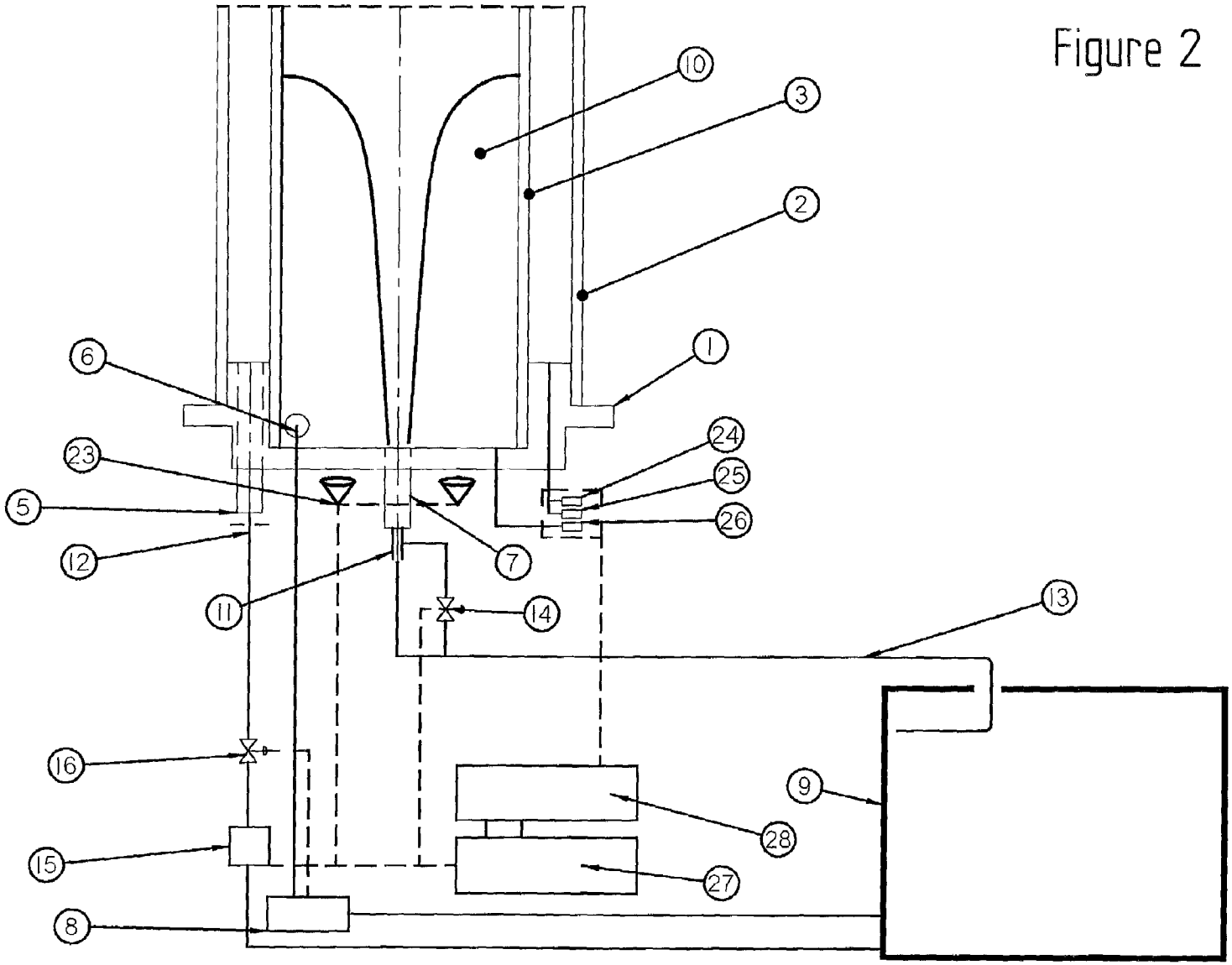
FIG. 2 is an enlarged view of the lower portion of the embodiment of FIG. 1*a;*
Figure 3:
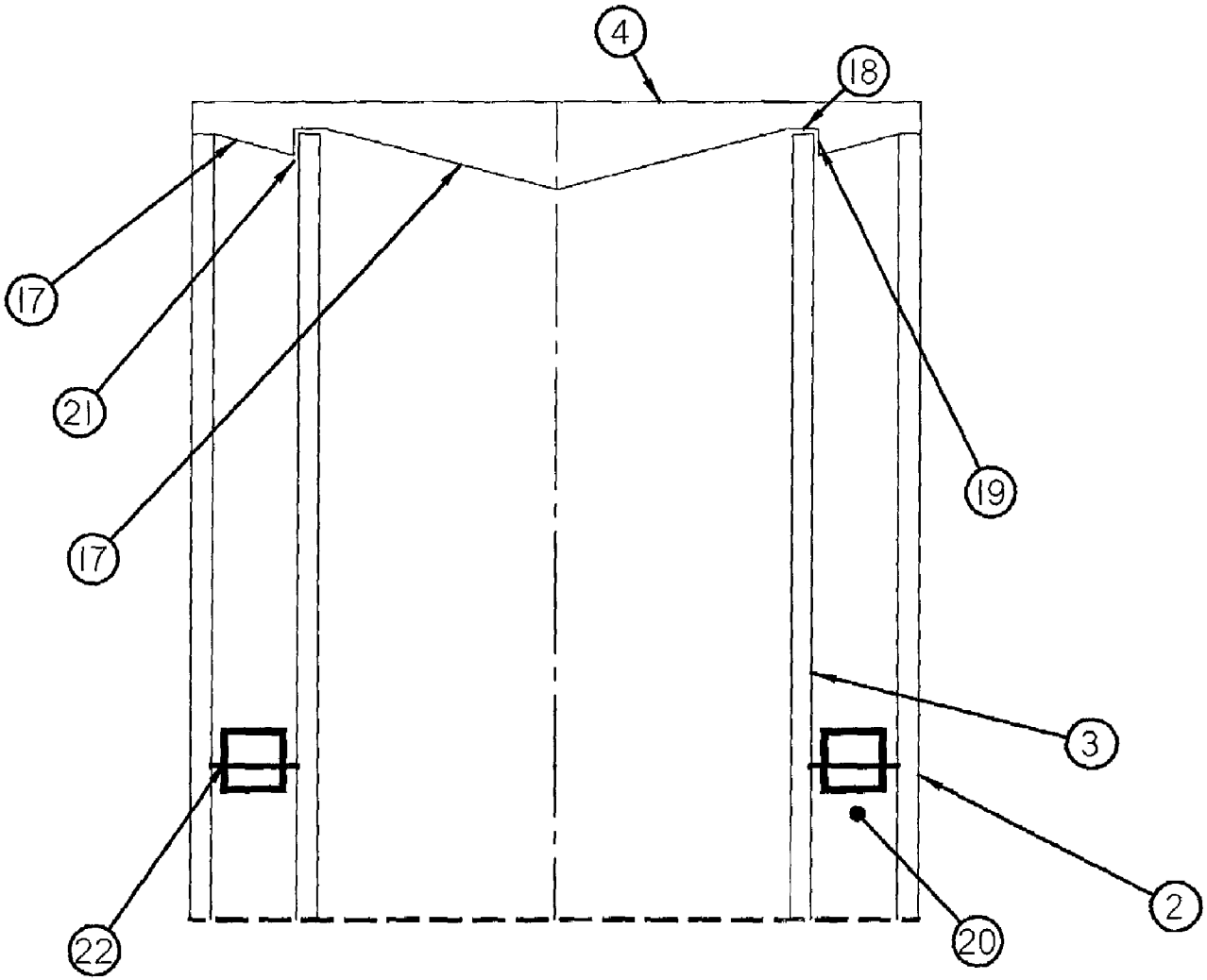
FIG. 3 is an enlarged view of the upper portion of the embodiment of FIG. 1*a;*

The first embodiment uses a centrifugal type pump for both the inner tube fill pump 8 and the outer tube fill pump 15. It is illustrated in FIGS. 1 to 3 and takes the form of a clock.

The main clock components are the manifold 1 connected and sealed to an outer tube 2, an inner tube 3 and a co-venting but outwardly sealed lid 4 which allows air to pass between the outer tube 2 and the inner tube 3. The manifold 1 has connections for an outer tube fill and drain port 5, an inner tube tangential fill port 6 and an inner tube drain port 7. Rigid or flexible conduits can be connected to these ports. Water which can be discharged through the inner tube tangential fill port 6 enters on the tangent to the inner wall of the inner tube 3. The inner tube drain port 7 is on the central axis of the inner tube 3. If water is pumped into the inner tube 3, through the inner tube tangential fill port 6 from an inner tube fill pump 8, which draws water from a sump 9 at a rate in excess of the flow out of the inner tube drain port 7, which is ducted back to the sump 9, then the level of water in the inner tube 3 will rise as a vortex of water 10 is formed. If the pumping rate. is less than the drain rate, then the inner tube 3 will empty, if it has previously been filled, or will not fill up if it is already empty.

The basic rate of drain of the inner tube 3 is affected, and therefore set, by a controlling tube 11, set near to (and it could be within) and concentric with the inner tube drain port 7. To achieve a faster rate of drain, the inner tube drain bypass valve 14 can be opened. This allows a greater drain flowrate than can pass through the controlling tube 11, whilst leaving the flow (and air column) through the controlling tube 11 substantially undisturbed. Downstream of the controlling tube 11, the diameter of the secondary inner tube drain pipe 13 is increased to have a cross sectional area about 50% greater or more than the controlling tube 11. The diameter of the pipework supplying the inner tube drain bypass valve 14 can be approximately the diameter of the secondary inner tube drain pipe 13. The inner tube drain bypass valve 14 can be opened during the drain cycles.

The outer coaxial water column 20 is contained between the inner wall of the outer tube 2 and the outer wall of the inner tube 3. If outer tube fill pump 15 is on and valve 16 is open, then so long as the pump is able to deliver a head in excess of that created by water already above it, the outer coaxial water column 20 will increase in height. If the filling, from outer tube fill pump 15, through the outer tube fill and drain port 5 is stopped and the outer tube drain valve 16 is open, then the volume of water will be enabled to drain through the outer tube fill and drain port 5 and back to the sump 9. The height of the outer coaxial water column 20 could decrease to nothing. The rate of outflow of water would be reduced if the pump is left partially on. Flow limiting means 12, which may be designed and configured to operate in just one or in both directions (or to be bypassed), can be fitted in line with the outer tube fill and drain port. Alternatively separate fill and drain ports with independent valve arrangements may be utilised.

The top of outer tube 2 is sealed with the outwardly sealed lid 4 which can protrude downwards to provide a run off for drops of condensation 17 that may form. The inner tube 3 can finish axially just short of the outer tube 2 leaving a communicating air gap 18. Support 19 to prevent movement of the inner tube 3 away from the axis can be provided for.

Inner tube 3 can be filled with water to the top and can over flow water into the volume formed between inner tube 3 and outer tube 2. Similarly the outer coaxial water column 20 could increase in height such that it spills in to the inner tube 3. The venting gap 21 allows both air and water to pass both ways (see FIG. 3).

A float 22 can be loose fitted and will rest on the outer coaxial water column 20 (See FIG. 3). This highlights the position towards the top of the outer coaxial water column 20. Lighting 23 is fitted below the manifold. A pressure switch 24 is fitted to protect the tubes against over pressure should it occur. An inner tube pressure transmitter 25 can be fitted to the manifold 1 at the bottom of the inner tube 3 and an outer tube pressure transmitter 26 can be fitted to the manifold I at the bottom of the outer tube 2. These allow a feedback control system for the levels of water in the inner tube 3 and the outer coaxial water column 20.

The invention is controlled with electronic control means 27 and electronic timing means 28 which can have inputs from the pressure switch 24, the inner tube pressure transmitter 25 and the outer tube pressure transmitter 26. The inner tube fill pump 8, the outer tube fill pump 15, the inner tube drain bypass valve 14 and the lighting 23 are controlled and actuated by the electronic control means 27, which is linked to, and can be integral with, the electronic timing means 28 (See FIG. 2).

The action of the clock according to this first embodiment is now described.

The level of the vortex of water 10 in the inner tube 3 indicates the minutes in an hour. Just after the start of a new hour period, the inner tube fill pump 8 starts to ramp up in speed and supplies water to the inner tube tangential fill port 6. The flowrate of water through the inner tube tangential fill port 6 is governed by the time of the hour and programmed to increase so that the fill level of the vortex of water 10 corresponds to the minutes elapsed during the hour. The level of the vortex of water 10 will, therefore, increase from a low level (indicating the start of an hour) to a high level (indicating the end of an hour). This occurs because during the fill cycle, the speed of the inner tube fill pump 8 is increased over the hour and the delivered flowrate of water is always increasing beyond that which can flow out through the inner tube drain port 7. The air that was previously occupying the volume bounded between the inner tube 3, the manifold 1 and the outwardly sealed lid 4 is displaced by the water. Because of the formation of the vortex with the air core, this is able to pass out of the clock through the inner tube drain port 7 simultaneously with the water.

At the end of an hour, the inner tube 3 is emptied. This is achieved by reducing the rate of the inner tube fill pump below the rate at which water is flowing out of the inner tube drain port 7 and back to the sump 9. The drain rate can be increased by opening the inner tube drain bypass valve 14. In the clock, the rate of the inner tube fill pump 8 should be reduced as much as possible so that the emptying occurs quickly. It is necessary however to maintain the swirl of the vortex otherwise the flow of air through the inner tube drain port 7 can not be maintained. It is not always essential to open the inner tube drain bypass valve 14 but this can make the emptying faster. This emptying cycle can occur in approximately the first thirty seconds or minute of the next, new hour. After the emptying, if the inner tube drain bypass valve 14 had been opened, then it must be closed and the cycle repeats with the inner tube fill pump 8 being controlled to provide the correct, increasing, flowrate over the remaining portion of the new hour. This cycle repeats all the time the clock is running.

The outer coaxial water column 20, which can have an optional float 22 on top, is supplied from the outer tube fill pump 15. The flow of water to the outer tube fill and drain port is controlled both by the outer tube fill pump and the outer tube drain valve 16. If the outer tube drain valve is closed, then water will neither flow into or out of the outer coaxial column 20. If the outer tube drain valve 16 is opened and the rate of pumping of the outer tube fill pump is sufficient to overcome the head of water in the outer coaxial water column 20, then the water level will rise. If it is less than the head of water in the outer coaxial water column 20, then the water level will fall.

In this first embodiment, it can be assumed that the water level of the outer coaxial water column 20, corresponding to the start of the new 12 hour period, is at a very low visible water level of the manifold. Therefore, the electronic control and timing means 27 and 28 will cause the outer tube fill pump 15 to ramp up in speed to a level which will just cause the water level to cause the float 22 to lift off its lowest setting by a very small amount (corresponding to the start of the new 12 hour period). The outer tube drain valve 16 will be open whilst the electronic control and timing means 27 and 28, control the outer tube fill pump 15 to achieve the correct water level. When the water level is set, the outer tube drain valve 16 will close and the outer tube fill pump 15 will be switched off for the remainder of the following hour. Just before the clock is to indicate the passing of one hour into the new 12 hour period, the outer tube fill pump 15 is ramped to a level which would cause the level of the outer coaxial water column 20 to rise towards the marking of the water level of the next hour. Once the outer tube fill pump 15 is ramped to at least the level of the current hour, the outer tube drain valve 16 is opened. The outer tube fill pump 15 can be controlled to deliver water such that the level of water in the outer coaxial water column 20 increases to the next hour in a visually attractive and repeatable way. This process continues hourly. At the end of the 12 hour cycle, the outer tube fill pump 15 is ramped down and the outer tube drain valve 16 is opened so that the water drains back to the sump 9. The 12 hour cycle repeats all the time the clock is running.

Figure 4:
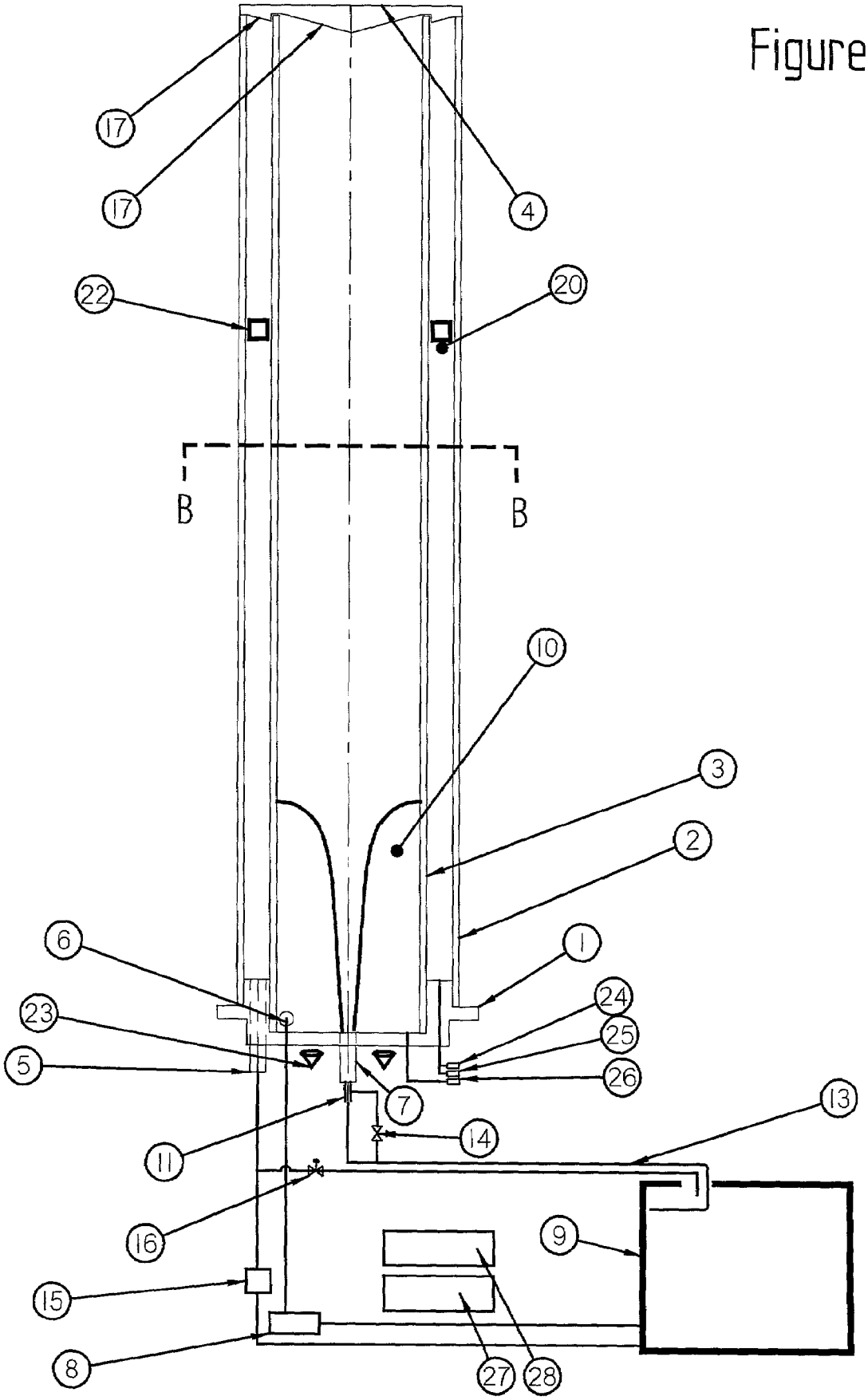
FIG. 4 is a schematic side sectional view of a water feature according to a second embodiment of the invention.
Figure 5:
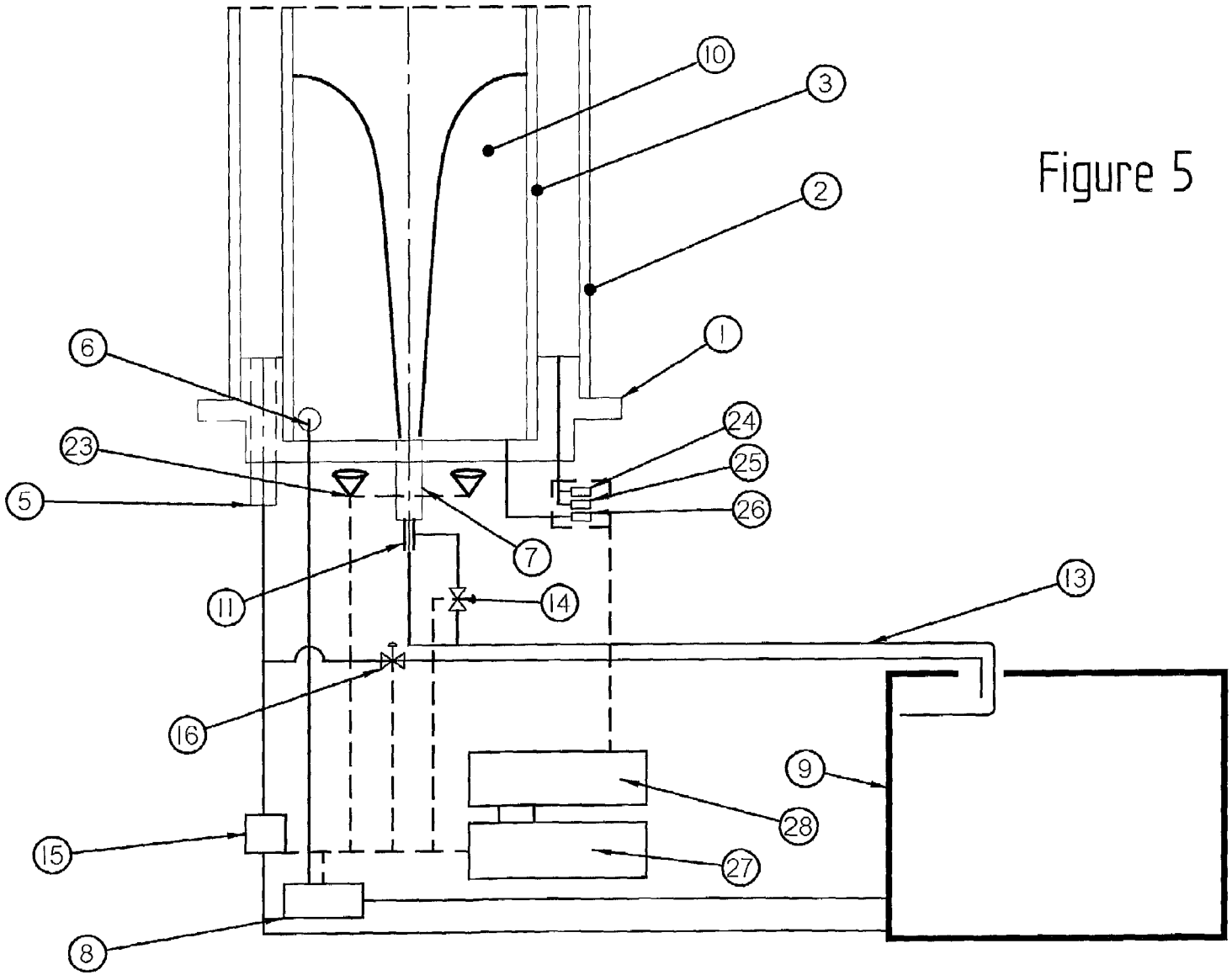
FIG. 5 is an enlarged view of the lower portion of the second embodiment shown in FIG. 4.

The second embodiment also uses a centrifugal type pump for the inner tube fill pump 8 but uses a dosing pump for the outer tube fill pump 15. Unlike in a centrifugal pump, water can not flow backwards through a dosing pump. This second embodiment is illustrated in FIGS. 4 and 5 and also takes the form of a clock. FIGS. 1*b* and 3 also apply to this embodiment.

The main construction of the clock and functioning of the inner tube 3 is the same as that described for the first embodiment and so the description is not repeated. The system describing and controlling the outer coaxial water column 20 is different and so is described hereafter.

The outer coaxial water column 20 is contained between the inner wall of the outer tube 2 and the outer wall of the inner tube 3. If water is supplied to this tube from the outer tube fill pump 15 and it is not allowed to drain away, because valve 16 is closed, then the outer coaxial water column 20 will increase in height. If the outer tube drain valve 16 is open and the filling through the outer tube fill and drain port 5 is stopped, then the volume of water will be enabled to drain through the outer tube fill and drain port 5 and back to the sump 9. The height of the outer coaxial water column 20 could decrease to nothing.

The action of the outer coaxial water column 20, in this second embodiment, clock is now described.

The outer coaxial water column 20, which can have an optional float 22 on top, is supplied from the outer tube fill pump 15. If the outer tube drain valve 16 is closed and the outer tube fill pump 15 is on, then the outer coaxial water column 20 will increase in height. The electronic control and timing means 27 and 28 ensure that, just past the start of a 12 hour cycle (12 noon or 12 midnight), the outer tube drain valve 16 is closed and the outer tube fill pump is switched on. The outer tube fill pump 15 can be controlled to deliver water such that the level of water in the volume 20 increases from a low level to a high level over 12 hours. At the end of the 12 hour cycle, the outer tube fill pump 15 is switched off, the outer tube drain valve 16 is opened and the water drains back to the sump 9. After the empty cycle, just into the start of the new 12 hour period, the outer tube drain valve 16 is closed and the outer tube fill pump 15 is switched on again. This cycle repeats all the time the clock is running.

Figure 6:
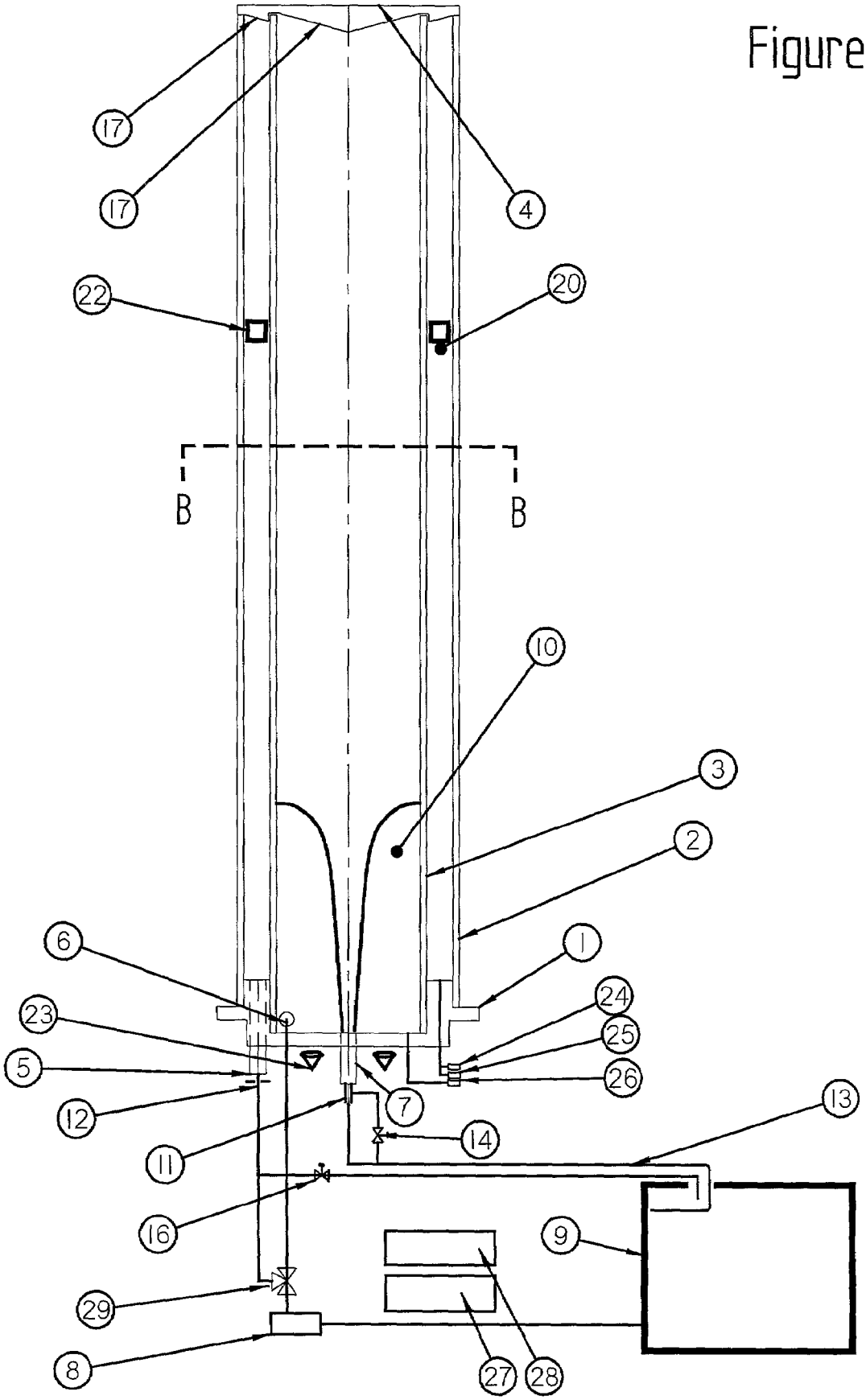
FIG. 6 is a schematic side sectional view of a water feature according to a third embodiment of the invention.
Figure 7:
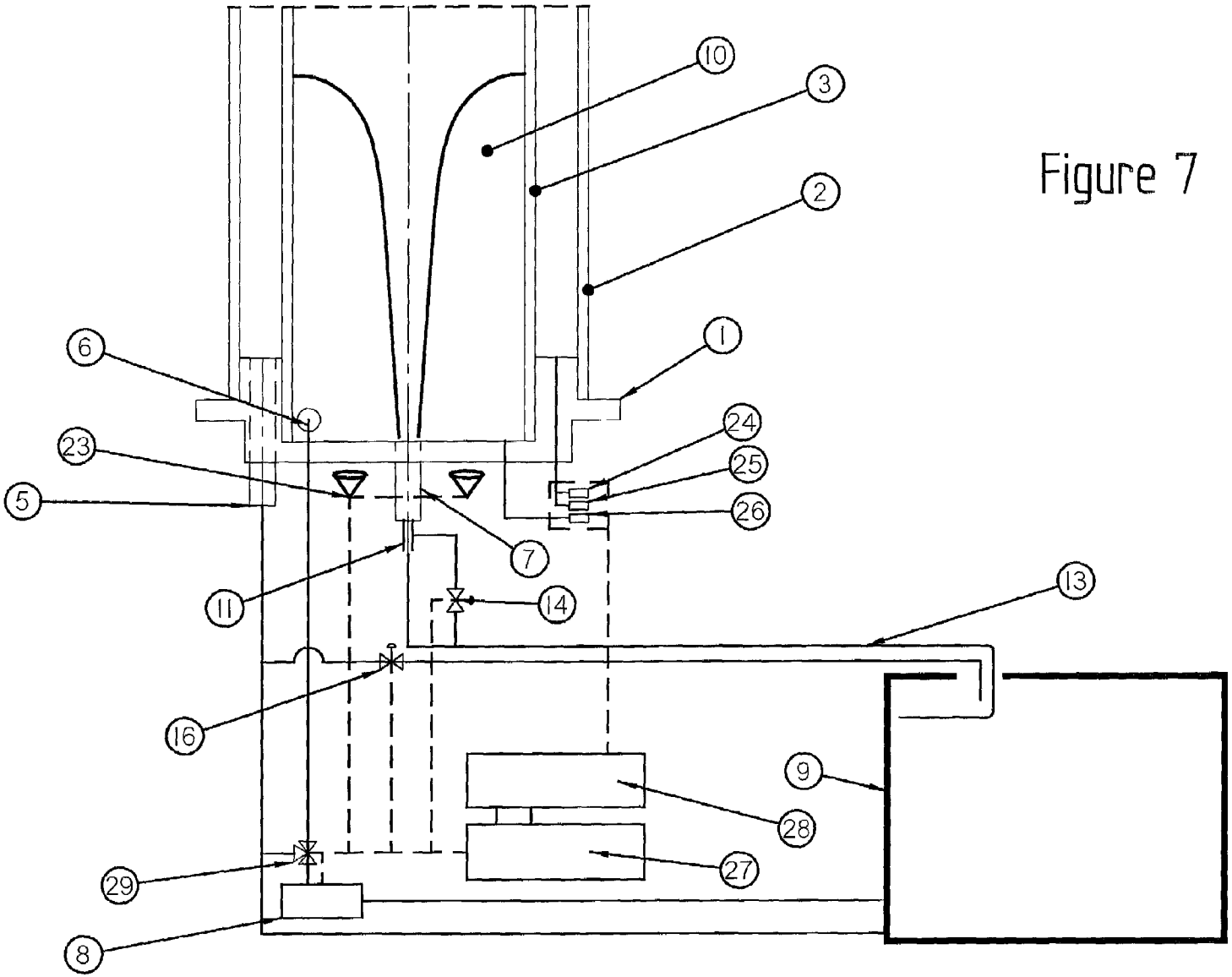
FIG. 7 is an enlarged view of the lower portion of the third embodiment shown in FIG. 6.

The third embodiment uses one centrifugal type pump between both columns. It is illustrated in FIGS. 6 and 7 and also takes the form of a clock. FIGS. 1*b* and 3 also apply to this embodiment.

In the two previously described embodiments, two pumps are used to supply water to the clock. The inner tube fill pump 8 supplies flow to create the vortex of water 10 and the outer tube fill pump 15 (which could either be a dosing or centrifugal pump) supplies flow to the outer coaxial water column 20.

In this further embodiment now described, the inner tube fill pump 8 (which is a centrifugal type pump) is used alternately to provide a flow of water for the vortex of water 10 and the outer coaxial water column 20.

The outer tube fill pump 15 is not required. A three way divertor valve 29 is now fitted after the inner tube fill pump 8. The operation of this single-pump embodiment of the clock is now described from the start of a new 12 hour period. For this description, it is assumed that the clock is switched on, having been off (and empty), at the end of the last 12 hour period.

The three way divertor valve 29 is positioned so that the flow from the inner tube fill pump 8 is diverted to inner tube 3, via the inner tube tangential fill port 6. The level of the vortex of water 10 in the inner tube 3 indicates the minutes in an hour and will be filled and emptied as previously described in embodiments one and two.

At the end of a one hour period the inner tube fill pump will have been ramped down to a substantially low level. The outer tube drain valve 16 will be closed. The three way divertor valve 29 is now switched so that the flow from the inner tube fill pump 8 is directed into outer tube fill and drain port 5.

The inner tube fill pump 8 ramps to a speed which is sufficient to cause the level of water in the outer coaxial water column 20 to move to the next hour setting (which would be one o'clock in this illustration of the process) in an appropriate manner as described in the first embodiment.

When the outer coaxial water column 20 has reached the next appropriate hourly level, the three way divertor valve 29 is switched to divert the water flow to the inner tube 3 and the inner tube fill pump 8 is simultaneously ramped to a substantially low level corresponding to the start of the next hour. The rate of the inner tube fill pump 8 is then varied over the next hour to provide the indication of minutes.

At the end of the hour, the empty cycle of the inner tube 3 is repeated. The three way divertor valve 29 is switched to fill the outer coaxial water column 20 and the inner tube fill pump 8 is set at a level which causes the level of the outer coaxial water column to rise to the next hour level (two o'clock in this illustration).

The process continues over the rest of the twelve hour cycle, with the outer coaxial water column 20 being indexed upwards to the next hour level immediately following the turn of the hour.

When twelve o'clock has been reached (which is the end of a cycle), the outer coaxial water column 20 is emptied by opening the outer tube drain valve 16. This is opened as the time moves into the next twelve hour period. Therefore, at the start of a new twelve hour period, both the vortex of water 10 and the outer coaxial water column 20 empty. After the empty cycle, just into the start of the new 12 hour period, the outer tube drain valve 16 is closed and remains closed for the remainder of the 12 hour cycle. This cycle repeats all the time the clock is running.

Figure 8:
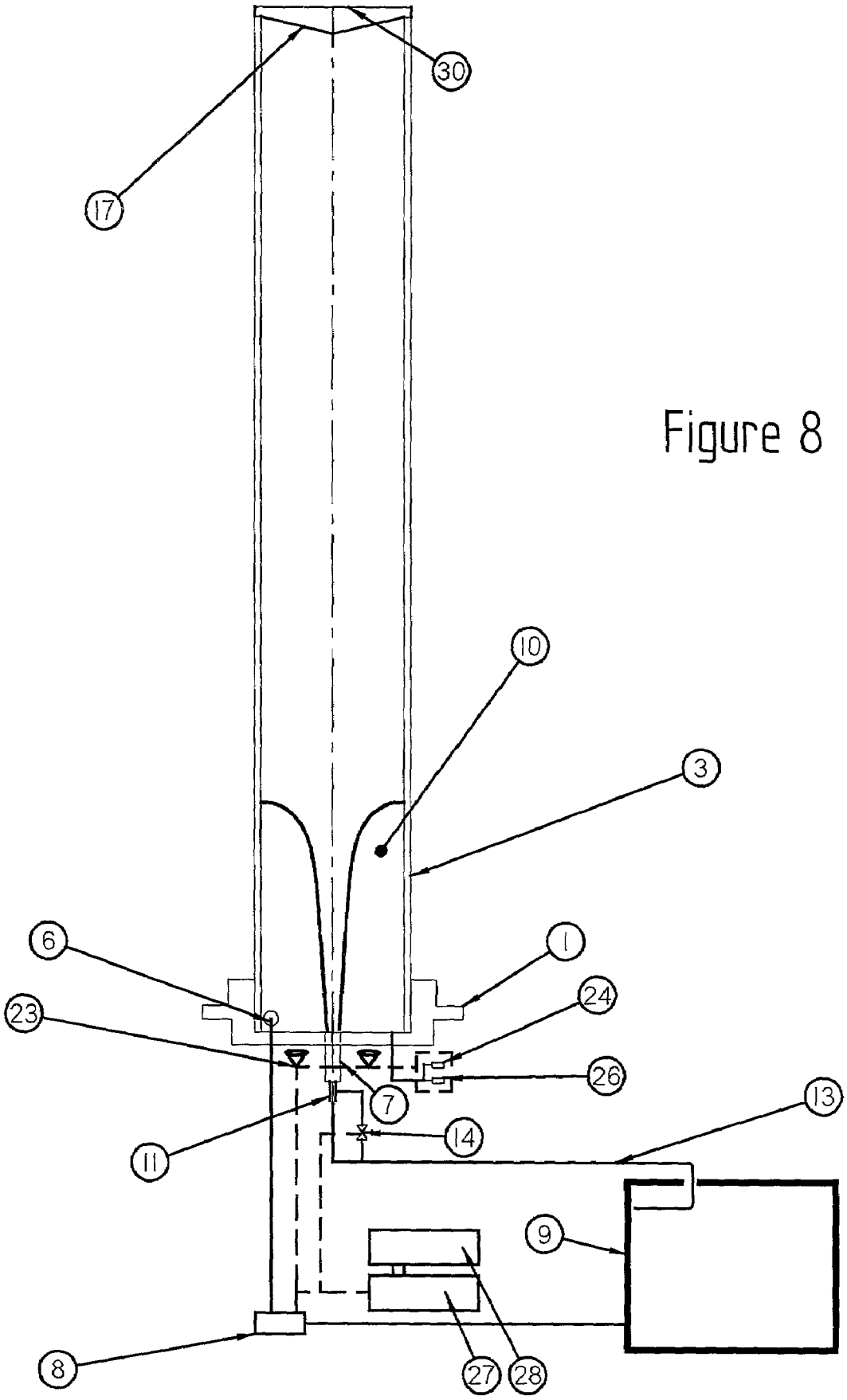
FIG. 8 is a schematic side sectional view of a water feature according to a fourth embodiment of the invention.

A fourth embodiment of the invention is shown in FIG. 8, which is a schematic side sectional view of a water feature. There is just a single inner tube 3, with no outer tube 2. The single tube sealed lid 30 prevents the escape of air of water from the top of the inner tube 3. The vortex of water 10 forms within the inner tube 3. The height of the vortex 10 can be controlled with the electronic control means 27 and the electronic timing means 28. The pressure switch 24 is connected to the manifold 1 at the bottom of the inner tube 3. The inner tube pressure transmitter 26 can also be fitted to the manifold 1 at the bottom of the inner tube 3. This embodiment may or may not be used as a timer or clock.

The inner tube 3 and the outer tube 2 can be graduated to assist with reading the time of day. This is not essential. The lighting 23 can be on all the time or switched on and off by the electronic control and timing means 27 and 28.

In the above embodiments, the vessel and further vessel for the water are shown as cylindrical tubes. Further tube configurations exist.

Figures 9A, 9B, 9C, 9D:
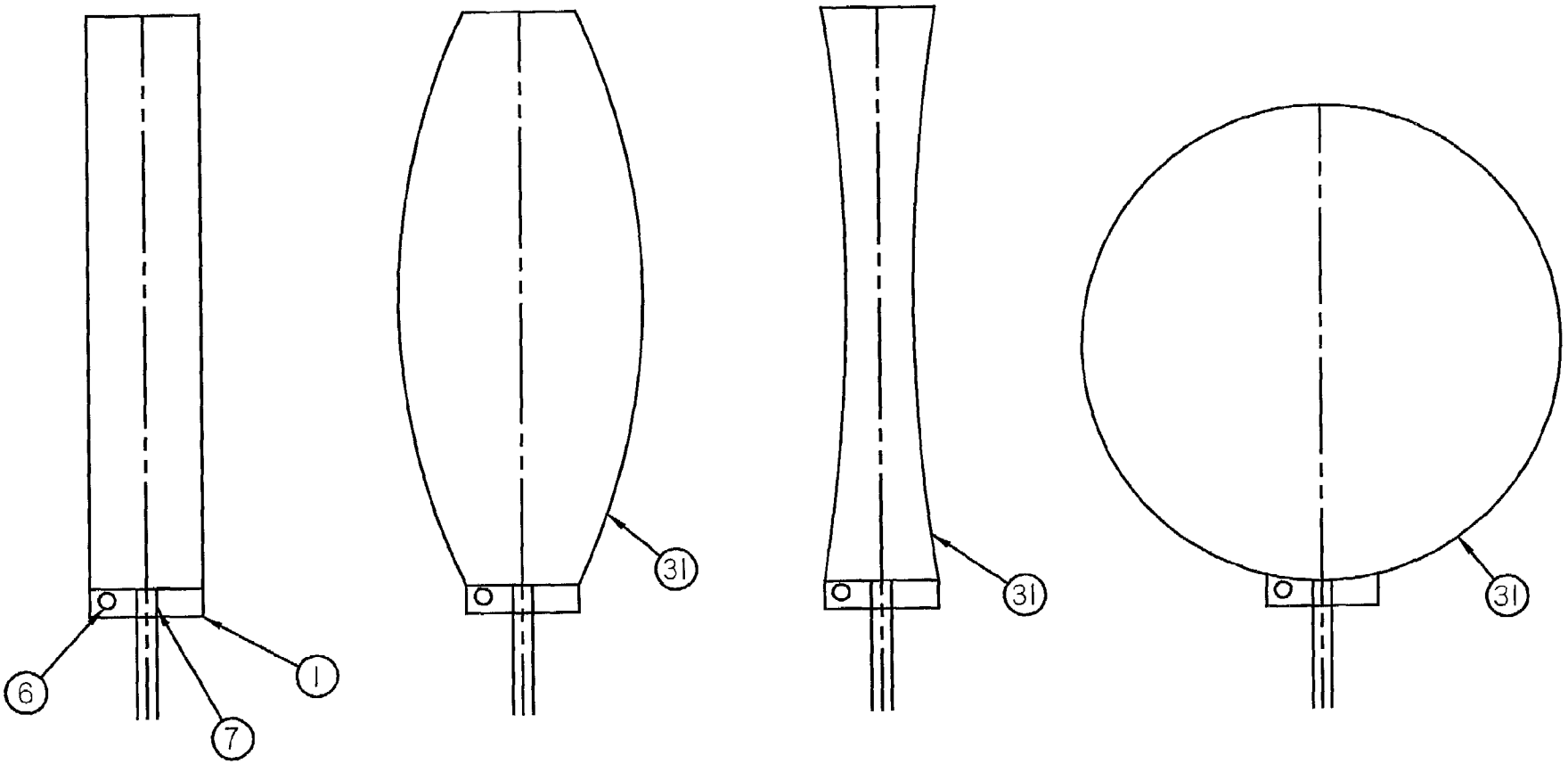
FIGS. 9*a* thro 9*i* show various alternative forms of vessel and further vessel.
Figure 9G:
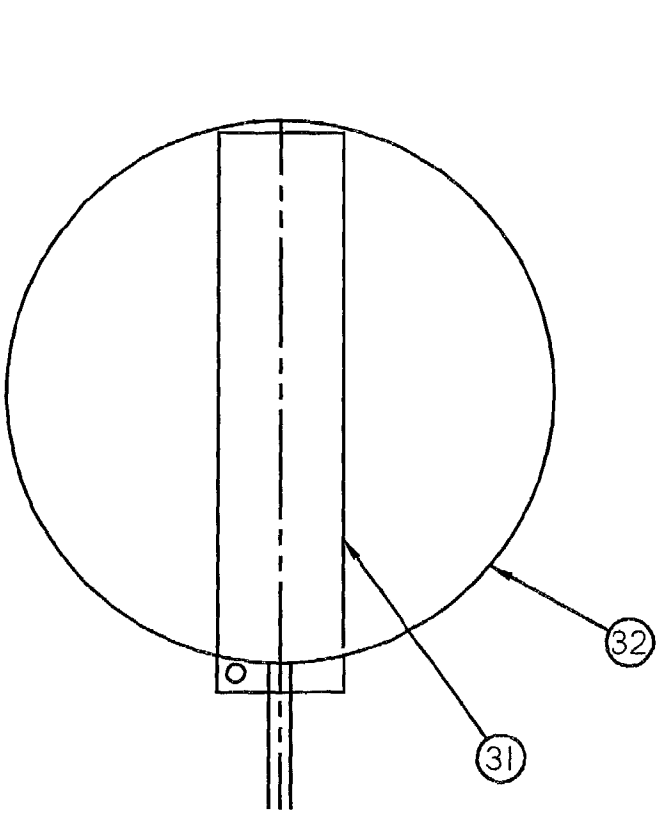
Figure 9F:
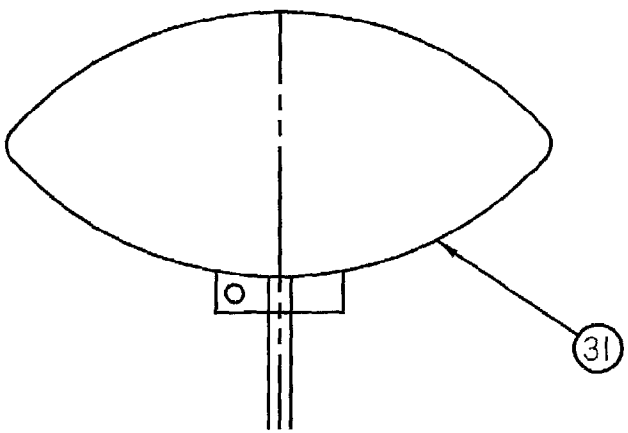
Figure 9E:
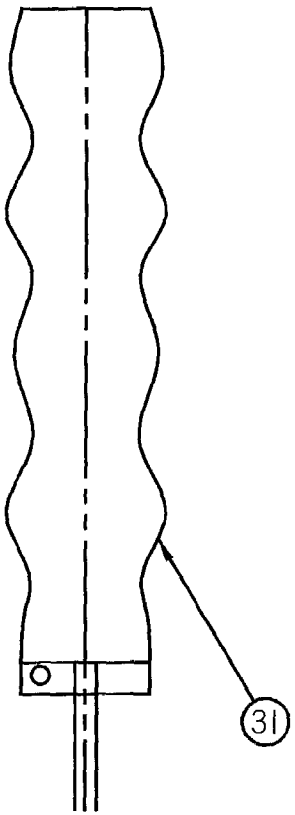
Figure 9I:
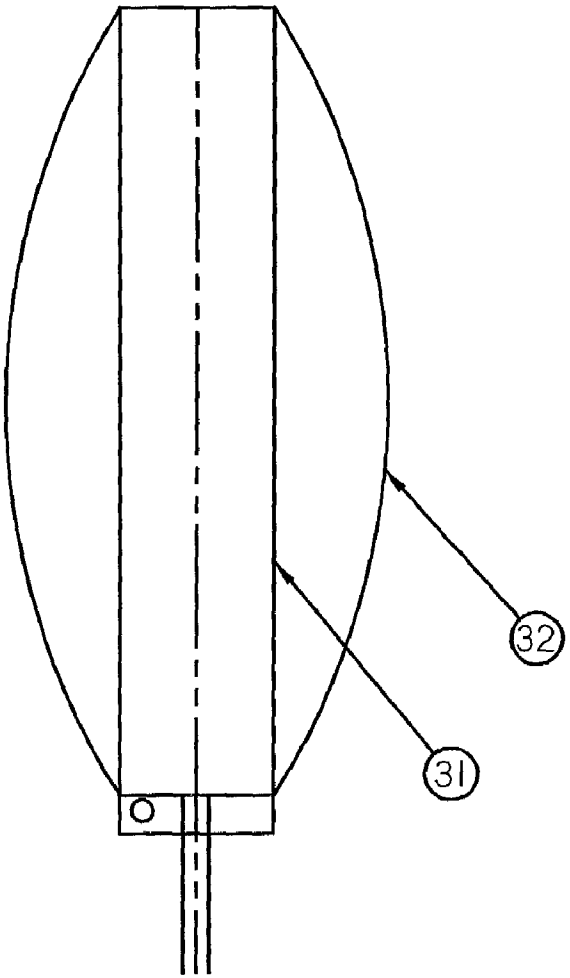
Figure 9H:
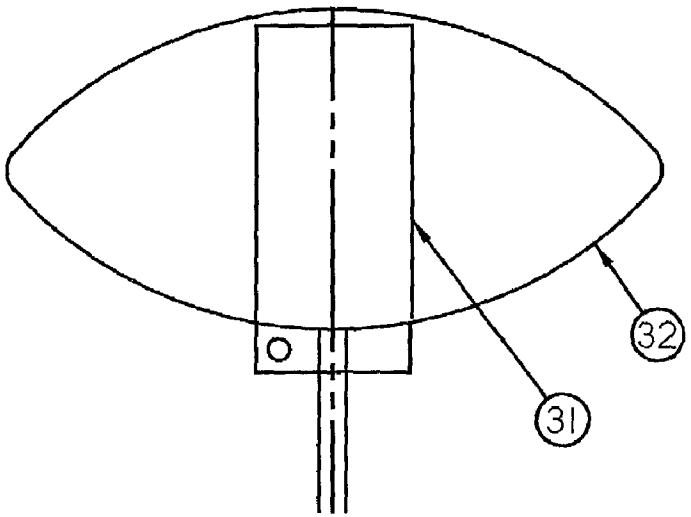

As a reference, FIG. 9*a* shows a vessel as a cylindrical tube. In FIG. 9*b*, the vessel is a convex tube. In FIG. 9*c*, the vessel is a concave tube. In FIG. 9*d*, the vessel is substantially spherical. In FIG. 9*e*, the vessel is approximately tubular, its area varying along its axis. In FIG. 9*f* the vessel is substantially elliptical. In FIG. 9*g*, a cylindrical-tube vessel is contained within a further vessel which is substantially spherical. In FIG. 9*h*, a cylindrical-tube vessel is contained within a further vessel which is substantially elliptical. In FIG. 9*i*, a cylindrical-tube vessel is contained within a further vessel which is convex.

Different combinations of vessels and further vessels can be accommodated depending upon the practicality of the design. Optional floats can be fitted on the outer coaxial water column 20 which is contained between the vessel and the further vessel.

Within the invention, means are provided to securely support the manifold. Covers can be provided to conceal the porting and plumbing arrangements. Water can flow in both directions through the inner tube tangential fill port 6. The outer tube fill and drain port 5 could become two ports, one for filling and one for emptying the outer coaxial water column 20. Separate valving could be provided for the fill and empty cycles.

In all embodiments of the invention, filters can be fitted in the supply of water to the inner tube 3 and the outer tube 2. Air filters can also be provided to prevent dust entry into the water feature system as a whole.

The water in the sump 9 can be treated to keep it clean using some or all of the following:—de-ionisation, filtration, chemicals and UV light.

The inner tube 3 and the outer tube 2 can be run separately and be sealed separately if desired. The outer tube 2 and the inner tube 3 could be separately sealed at the top. Inner tube 3 would vent through the inner tube drain port 7. Outer tube 2 would require means for air to be discharged during filling and admitted during emptying. The air for emptying could be achieved by pumping it in.

In the embodiments shown, gravity (alone) is used to cause the water to fall back to the sump. A separate pump, which could be an ejector pump, could be provided. And an air over pressure could be applied to increase the drain rate.

The drain tube system comprising 7, 11, 14 can be simplified. The inner tube drain bypass valve 14 is not essential.

The inner tube tangential fill port 6 can be optimised. It may take the form of several smaller inlets rather than one larger single inlet.

The outwardly sealed lid 4 and the single tube sealed lid 30 can be made removable from the outer tube 3 and inner tube 2, as appropriate, but can be sealed, for example, with an O ring or silicone.

If it is desired not to fully fill the inner tube 3 containing the vortex of water 10 then the outwardly sealed lid 4 and the single tube sealed lid 30 can have a cone-like section protruding downwards allowing any condensation droplets to run off.

The three way divertor valve 28 can be replaced with two independent on/off flow control valves.

Electronic control and timing means can be provided to detect power cuts (short or long term) and the water levels in both columns can be restored.

It is to be understood that any suitable liquid can be used in place of water if desired.

List of Reference Numerals

| | |
|---|---|
| 1 | Manifold |
| 2 | Outer tube |
| 3 | Inner tube |
| 4 | Outwardly sealed lid |
| 5 | Outer tube fill and drain port |
| 6 | Inner tube tangential fill port |
| 7 | Inner tube drain port |
| 8 | Inner tube fill pump |
| 9 | Sump |
| 10 | Vortex of water |
| 11 | Controlling tube |
| 12 | Flow limiting means |
| 13 | Secondary inner tube drain pipe |
| 14 | Inner tube drain bypass valve |
| 15 | Outer tube fill pump |
| 16 | Outer tube drain valve |
| 17 | Condensation |
| 18 | Communicating air gap |
| 19 | Inner tube support |
| 20 | Outer coaxial water column |
| 21 | Venting (gap) between outer tube and inner tube 3 |
| 22 | Float |
| 23 | Lighting |
| 24 | Pressure switch |
| 25 | Inner tube pressure transmitter |
| 26 | Outer tube pressure transmitter |
| 27 | Electronic control means |
| 28 | Electronic Timing means |
| 29 | Three way divertor valve |
| 30 | Single tube sealed lid |
| 31 | Vessel |
| 32 | Further vessel |

I claim:

1. A water feature comprising a vessel for containing a volume of water and having a body, a central longitudinal axis, a water inlet and a water outlet, the water inlet being arranged substantially tangentially to the body of the vessel so as to impart rotational movement to the volume of water around the central longitudinal axis when water is introduced thereto, a controller for controlling the rate of water inlet in comparison to the rate of water outlet so as to vary the height of the volume of water in the vessel and a timing device in association with the controller so that the height of the volume of water in the vessel can be varied over a predetermined period of time, wherein the water outlet is a central drain located on or near and extending generally along the central axis of the vessel and located and configured so that water exiting the vessel flows generally in a direction of the central axis.

2. A water feature as claimed in claim 1, wherein the timing device is adapted to vary the height of the volume of water in the vessel between a minimum height and a maximum height over a predetermined period of one hour.

3. A water feature as claimed in claim 1, further comprising a sump with which the water inlet and water outlet of the vessel communicate, the sump comprising a vent to allow air travelling along the water outlet to be vented in preference to entering the water inlet.

4. A water feature as claimed in claim 1, wherein the water outlet has a drain port and a downstream portion, the downstream portion having a diameter which is greater than that of the drain port.

5. A water feature as claimed in claim 1, wherein an airtight lid is provided on the upper end of the vessel body to prevent water overflow therefrom.

6. A water feature as claimed in claim 1, wherein the body of the vessel comprises a cylindrical tube having a circular cross-section.

7. A water feature as claimed in claim 1, further comprising a further vessel which is arranged coaxially with the vessel, the further vessel having a body, a water inlet and a water outlet and a controller for controlling the rate of water inlet in comparison to the rate of water outlet so as to vary the height of the volume of water in the further vessel.

8. A water feature as claimed in claim 7, wherein the further vessel surrounds the vessel.

9. A water vessel as claimed in claim 8, wherein the further vessel is substantially spherical or cylindrical.

10. A water feature as claimed in claim 9, further comprising a timing device in association with the controller so that the height of the volume of water in the further vessel can be varied over a predetermined period of time.

11. A water feature as claimed in claim 10, wherein the timing device is adapted to vary the height of the volume of water in the further vessel between a minimum height and a maximum height over a predetermined period of twelve hours.

12. A water feature as claimed in claim 7, wherein a float is provided in the further vessel.

13. A water feature as claimed in claim 7, wherein a first pump is provided for introducing water to the vessel and a second pump is provided for introducing water to the further vessel.

14. A water feature comprising:

(a) a water reservoir;

(b) a first vessel having a body, a water inlet communicating with the water reservoir and a water outlet communicating with the water reservoir, the water inlet being arranged so as to introduce water tangentially to the body of the first vessel;

(c) an inlet valve associated with the water inlet of the first vessel and an outlet valve associated with the water outlet of the first vessel;

(d) a controller associated with the inlet valve of the first vessel and the outlet valve of the first vessel to allow the rate of water entry to the first vessel to be controlled with respect to the rate of water outlet therefrom;

(e) a second vessel having a body, a water inlet communicating with the water reservoir and a water outlet communicating with the water reservoir, the body of the second vessel surrounding the body of the first vessel;

(f) an inlet valve associated with the water inlet of the second vessel and an outlet valve associated with the water outlet of the second vessel, the water inlet of the second vessel and the water outlet of the second vessel being associated with the controller to allow the rate of water entry to the second vessel to be controlled with respect to the rate of water outlet therefrom;

(g) a first pump for transferring water from the water reservoir to the water inlet of the first vessel; and (h) a second pump for transferring water from the water reservoir to the water inlet of the second vessel.

15. A method of operating a water feature comprising at least one closed vessel containing a volume of water, comprising:

(a) causing the volume of water to rotate about a central longitudinal axis of the closed vessel so as to form a vortex therein; and (b) causing the volume of water to vary in height over time, wherein water is continuously introduced to and drained from the closed vessel, the rate of introduction exceeding the rate of draining when the height of the water volume is increasing and the rate of draining exceeding the rate of introduction when the height of the water volume is decreasing.

16. A method of operating a water feature comprising at least one closed vessel containing a volume of water, comprising:

(a) causing the volume of water to rotate about a central longitudinal axis of the closed vessel so as to form a vortex therein; and (b) causing the volume of water to vary in height over time, wherein air is introduced to or removed from the closed vessel via an outlet of the vessel as the height of the volume of water is varied.

17. A method of operating a water feature comprising at least one vessel containing a volume of water, comprising the steps of:

(a) causing the volume of water to rotate about an axis of the vessel so as to form a vortex therein; and (b) causing the volume of water to vary in height over time, wherein the rotating volume of water is caused to vary in height over a predetermined period of time so as to provide, by its height, an indication of the time.

18. A method as claimed in claim 17, wherein the height of the rotating volume of water increases from a minimum height to a maximum height over a period of sixty minutes and a second volume of water, contained within a further vessel arranged so as to surround the vessel, is caused to increase in height from a minimum height to a maximum height over a period of twelve hours.

* * * * *